United States Patent [19]

Wallman

[11] Patent Number: 4,549,848

[45] Date of Patent: Oct. 29, 1985

[54] ARRANGEMENT FOR RADIAL FANS

[76] Inventor: Lennart Wallman, Harstenagatan 2, S-582 73 Linkoping, Sweden

[21] Appl. No.: 545,381

[22] PCT Filed: Jan. 19, 1983

[86] PCT No.: PCT/SE83/00012

§ 371 Date: Sep. 21, 1983

§ 102(e) Date: Sep. 21, 1983

[87] PCT Pub. No.: WO83/02646

PCT Pub. Date: Aug., 1983

[30] Foreign Application Priority Data

Jan. 21, 1982 [SE] Sweden ..... 8200317

[51] Int. Cl.[4] ..... F04D 29/44

[52] U.S. Cl. ..... 415/206; 415/208

[58] Field of Search ..... 415/206, 207, 208, 216, 415/217, 219 C, 157

[56] References Cited

U.S. PATENT DOCUMENTS

| | | | |
|---|---|---|---|
| 820,399 | 5/1906 | Davidson | 415/206 |
| 1,390,237 | 9/1921 | Conder | 415/206 |
| 2,287,822 | 6/1942 | Odor et al. | 415/206 |
| 2,290,423 | 7/1942 | Funk | 415/206 |
| 3,221,983 | 12/1965 | Trickler et al. | 415/206 |
| 3,523,743 | 8/1970 | Jolette | 415/206 |
| 3,824,028 | 7/1974 | Zenkner et al. | 415/219 C |
| 4,252,502 | 2/1981 | Scheidel | 415/206 |
| 4,448,573 | 5/1984 | Franz | 415/206 |

FOREIGN PATENT DOCUMENTS

| | | | |
|---|---|---|---|
| 1428057 | 3/1969 | Fed. Rep. of Germany | 415/206 |
| 2,441,988 | 3/1975 | Fed. Rep. of Germany | 415/206 |
| 2542963 | 4/1977 | Fed. Rep. of Germany | 415/206 |
| 2,633,781 | 2/1978 | Fed. Rep. of Germany | 415/206 |

*Primary Examiner*—Robert E. Garrett
*Assistant Examiner*—H. Edward Li
*Attorney, Agent, or Firm*—James E. Nilles

[57] ABSTRACT

A radial fan comprises a spiral-shaped fan housing (1) and a drum-shaped wheel (9) which rotates in the direction in which the spiral increases and has an opening (15) facing towards an intake (16) in the end wall (5) of the housing. The area of the duct (18) formed by the housing and the periphery of the wheel increases continuously from a point where the duct cross-section is smallest up to an outlet part (21) where the cross-section is greatest and where the area is at least equal to the radius (R) of the wheel times its length (L). The intake is made eccentric by a guide vane (23) installed at the opening and extending near the inside (17) of the wheel by an edge part (26) located after the said point, cutting off the cross-section of the duct outwardly of the outer end (13) of the wheel. The rear face of the guide vane and the end wall (5) form an inwardly facing flow surface (33) which extends over approximately half the periphery of the wheel. The wheel lentgh (L) is approximately two thirds or more of the internal axial dimension (H) of the housing, and is approximately equal to the radius (R) of the wheel.

7 Claims, 6 Drawing Figures

ARRANGEMENT FOR RADIAL FANS

The present invention relates to an arrangement for radial fans, particularly for use in oil-burners or in other applications with corresponding performance requirements. More specifically, the invention relates to a fan arrangement comprising a fan housing which, considered radially from the axial line of the fan, is in the form of a spiral with one end wall developed into an air intake; a drum-shaped wheel which is concentric with the axial line, is designed to rotate in the direction in which the spiral becomes larger, and has a plurality of forward-curving blades arranged in a ring and extending in the axial direction of the wheel from an inner end plate located at the base of the fan housing up to the outer end of the wheel where the latter has an opening facing towards the intake through which the air flows into the inside of the ring of blades.

For fans which are to be used in oil-burners, especially those for domestic boilers and other smaller appliances which operate intermittently, intensive development work has been carried out in recent times in an attempt to satisfy the demand for better performance. This concerns above all the pressure which a fan of a certain size should produce at the quantity of air suited to the appliance—the normal operating level of the fan. The fan pressure is very significant for rapid and effective combustion of the finely-dispersed oil which is delivered by the nozzle of the oil-burner, and it is also an important aim that the quantity of air delivered by the fan should vary as little as possible with the counter-pressure prevailing in the combustion chamber. The demand for keeping the quantity of air as constant as possible consequently means that the characteristic curve of the oil-burner fan (pressure as a function of quantity) should rise sharply through the operating level specified for the appliance.

The demand for a high fan pressure in the said type of appliance is motivated especially by the influence which the outside atmospheric conditions have on the starting-up function of an oil-burner. It is well-known that if the weather is damp and cold it becomes more difficult than in more favourable weather conditions to drive out the air which remains behind in the chimney and the combustion chamber after a stoppage. Even if ignition of the burner is preceded by a special venting phase, overcoming the counter-pressure which this "cold block" presents accentuates the need for a fan which, when the quantity of air flowing out is small or approaches nil, is able to produce a pressure many times greater than that which is maintained during operation at or around the operating level.

Since a radial fan produces a pressure which is proportional to the peripheral speed of the wheel, that is, is dependent on the diameter of the wheel, any improvement in relation to the pressure means that it is possible to avoid an otherwise inevitable increase in the diameter, or expressed another way, that it is possible to allow an oil-burner fan of a specific size to operate at a higher operating level, i.e. up to a higher capacity of oil per unit of time, than formerly. The solution which satisfies the demand for high fan pressure is consequently also valuable from the point of view of saving space and money.

A factor which makes matters more difficult in this connection is the noise which the fan produces and which normally increases with the pressure. However, for appliances in houses and similarly sensitive surroundings a fan design which produces an increased air pressure at the sacrifice of a low noise-level is not an acceptable solution. A higher noise-level also betrays an unnecessarily high consumption of energy in the fan and it is therefore appropriate to find a design which combines an improvement of the pressure/quantity of air performance of the fan while maintaining, or if possible reducing, the noise-level and keeping the consumption of energy low.

A large number of different designs have been produced over the years with the object of improving radial fans for oil-burners in the respects mentioned above. Particular interest has been shown in the shaping of the inlet nozzle, which has been equipped by a number of different manufacturers with a guide plate which extends into the fan wheel to improve the in-flow conditions, while others have sought to improve the shape of the so-called tongue, that is, the part of the housing wall which comes nearest to the ring of blades and forms the transition to the outlet pipe of the fan.

In the published Swedish Specification No. 7406642-4 (publication No. 392.521) one of the many designs is described wherein an attempt has been made to increase the performance of a radial fan in the above first-mentioned way. The design is characterised by a guide plate which substantially closes the space between the ring of blades on the fan wheel and the driving shaft, and which prevents the air which is flung out into the outlet duct in a peripheral direction from finding its way back into the fan wheel, contributing as has been asserted to building up the pressure in the outlet duct. The control plate is combined with a circular flange pointing towards the outer end of the wheel and extending round the inlet from edge to edge on the control plate, but leaving a gap open towards the end of the wheel with a view to allowing compressed air from the outlet duct to flow back into the inlet part if the counter-pressure downstream from the outlet is high, and thus to achieve a further increase in the pressure.

Whether or not this control plate and the inlet flange really produce any advantageous effect on the flow conditions around the fan wheel appears to be uncertain; in every case the measurable result of these measures—the characteristic curve of the fan in question—does not indicate that it produces the increase in pressure which is being sought. Measured in absolute figures, the performance of this fan thus lies at too low a level for it even to be able to meet the demands which are now being made for oil-burner applications.

It is therefore an object of the present invention to provide a radial fan of the above-mentioned type which has a better performance than that which is obtained with the previously known fan designs. An improvement is being sought here in particular which will result in higher values for the pressure produced by the fan; this involves both the maximum pressure which is obtained with a closed outlet pipe (the so-called dammed point), and the operating pressure which varies as a function of the quantity of air. Amongst other things, the improvement should result in an increased pressure level over the whole of the actual operating range. Furthermore, the characteristic curve should rise sharply so that a fan which is installed in an appliance where a certain operating level is set will deliver a substantially constant amount of air even if the counter-pressure of the fan should change somewhat during operation.

Another requirement which the invention seeks to fulfil is to increase the performance of the fan by improving the design so that, starting from a specific operating level and a specific required maximum pressure, it is possible to reduce the diameter of the fan wheel and thus the overall space requirement for the fan.

Still another object of the invention is to provide improved performances of a radial fan while maintaining a low noise level and a low consumption of energy.

These objects are achieved according to the primary characteristic of the invention by the combination of the following measures; the cross-section, viewed in a plane passing radially through the axial line, of the duct defined by the ring of blades and the fan housing increases continuously from an angular range within which the duct has its smallest cross-section, via a part which serves as a diffusor, to an outlet part where the duct merges into an outlet pipe and has its largest cross-section, so that the area of the latter is at least the same as the radius of the wheel times its length; the air intake is disposed eccentrically by means of a tongue-shaped guide vane which passes in through the wheel opening and which sweeps, by an edge part cut at an angle and located in the said angular range, closely over the inside of the ring of blades at a distance from the end plate which is approximately half the length of the wheel or less and cuts off the part of the duct cross-section which is located outwardly of the outer end of the wheel; the guide vane is tightly connected to the end wall at its outer part and, together with the inside of the end wall, forms an inwardly facing flow surface which extends, within an angular range which is approximately half the periphery of the wheel, over the outer end of the wheel up to the said edge part and merges smoothly into the wall of the diffusor part located radially outwardly of the flow surface and the length of the wall is approximately two thirds of the axial dimension from the said diffusor wall to the base of the fan housing, and is approximately the same as the radius of the wheel.

The continuous increase in the duct cross-section and the relationship between the area of the largest cross-section and the cross-section of the wheel has been found to be of prime importance for obtaining the greatest possible increase in pressure in the diffusor part, and corresponding to a typical feature of the radial fan of this invention the increase amounts to at least 3% for every 15° of the sprial. This increase in the area can occur simultaneously in the radial direction and in the axial direction; preferably, however, the increase is only in the radial direction.

In dimensioning the spiral it should also be ensured that the so-called tongue, or that part of the fan housing wall where the spiral begins and has its smallest radial dimension, is not placed so near to the ring of blades that the air rushing through this duct section gives rise to a disturbing level of noise. According to a preferred embodiment the duct can have a minimum radial dimension here of 2 to 3% of the diameter of the wheel, and of the same reason the radius of the tongue or the transition between the narrowest section of the spiral and the outlet pipe of the fan should be at least twice this dimension.

Besides the shaping of the duct, the guide vane and its disposition in the air inlet is of vital importance for ensuring that the fan according to the invention will give improved pressure/quantity of air values and here there is a series of design measures which in combination enhance the performance. The production of the improved design can therefore be regarded as an optimising process with a large number of parameters which each affect the performance on their own. These will now be described in detail in conjunction with the description of the preferred embodiments of the guide vane.

Generally speaking, the flow technology aim in this connection is that, by its shaping and positioning relative to the ring of blades on the wheel, the guide vane should facilitate and control the flow of the different streams of air on the suction and the pressure sides as far as possible, so that these do not disturb each other but can be developed and combined harmoniously. A prerequisite for high pressure at the dammed point with small quantities of air is thus that the guide vane should concentrate the portion of the inlet which is open to the outside towards a part of the wheel ring, preferably not more than half its periphery, which follows, in the rotational direction, immediately after the said edge part of the guide vane, while over the remaining part of the periphery of the wheel the guide vane allows a return flow of air from the diffusor part to the inside of the wheel, the rear face of the guide vane assisting this deflection around the outer end of the wheel. For the same reason, according to the invention there is a substantial free distance between the inner edge of the guide vane and the end plate on the fan wheel so that a certain amount of the air deflected from the pressure side will be able to penetrate into the suction side of the wheel to be mixed there with the air which is being sucked in from the outside towards the ring of blades. However, it is advantageous for the said edge part on the guide vane effectively to shut off the suction side from the part of the spiral-shaped duct located upstream of it, so that the sucking of air into the ring of blades is not disturbed by the high pressure air at the tongue. In the preferred embodiment of the guide vane the said edge part therefore extends radially through the duct right out to the wall of the spiral fan housing.

BRIEF DESCRIPTION OF DRAWINGS

The invention will now be described further with reference to the accompanying drawing, on which

DETAILED DESCRIPTION OF PREFERRED EMBODIMENTS OF THE INVENTION

Figure 1:
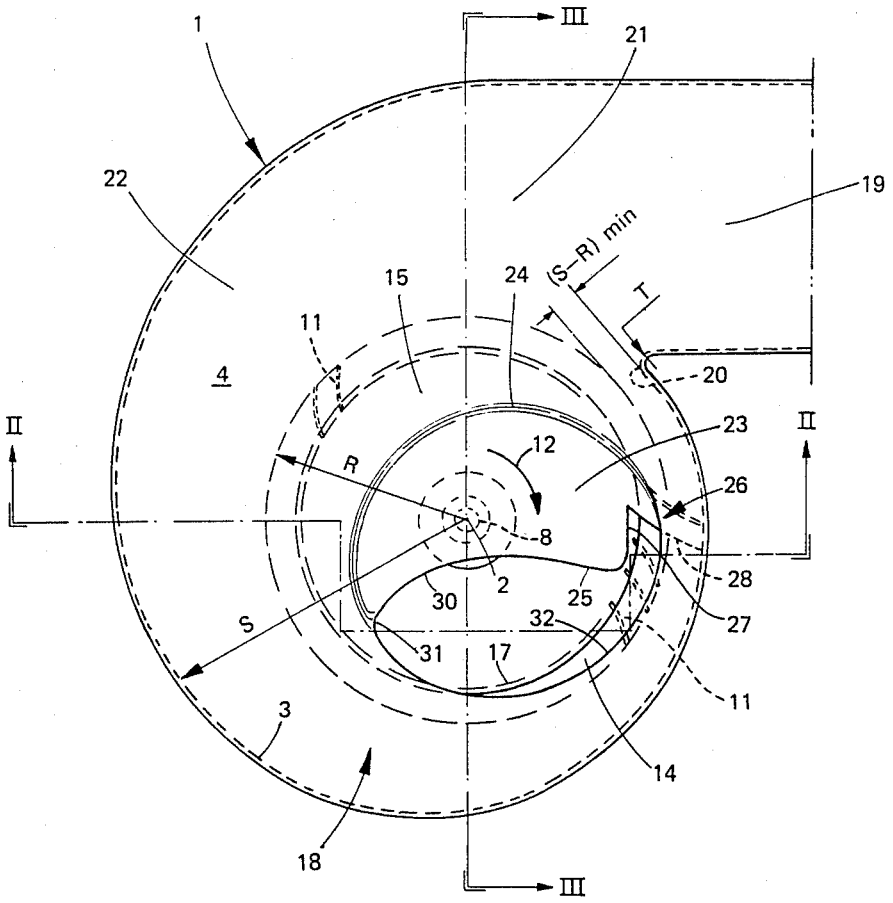
FIG. 1 is a plan view of a radial fan according to the invention.

On the drawing, 1 generally designates a fan housing which can be shaped out of plate or cast material into a spiral, viewed in a plane perpendicular to the axial line 2 of the fan. The spiral is defined internally by a spirally-shaped side wall 3, a base wall 4 and an end wall 5 located opposite the latter. These internal wall surfaces of the fan housing have a geometry which is a characteristic of the invention, while the external shape of the fan housing is not important and has therefore been shown schematically without the necessary joints and other details.

On the base wall 4 there is a guide edge 6 which is concentric with the axial line and is suitable for fixing in an electric motor 7 which can be of a conventional kind, expediently with a rotary speed of 2,800 r.p.m. at 50 Hz; only the drive shaft 8 and the fixing flange of this have been shown (partially in section). The fan wheel 9 is attached to the drive shaft so that its end plate 10 located nearest to the motor is on a level with the base wall 4.

The fan wheel is of the wheel-drum type and, in a known way, has a plurality of blades 11 arranged in a ring; these are curved forwards in the direction of rotation, shown with the arrow 12, and extend axially from the end plate 10 to the outer end 13 of the wheel where the blades are joined to an annular plate 14. This is concentric with the axial line and defines the circular in-flow opening 15 in the wheel.

The fan intake, designated 16, is disposed in the housing wall 5. The air which is to be conveyed by the fan is sucked in from here and reaches the inside 17 of the ring of blades via an open part of the wheel opening 15, after which the air is flung out by the blades at a high peripheral speed, into the fan housing duct 18, according to the operating principle of radial fans, and whilst flowing in the latter undergoes an increase in pressure before the air leaves through the outlet pipe 19 connected to the duct.

According to the present invention a combination of design measures which effect the flow formation in the fan and which in combination give it an optimum construction are required in order that a fan with the basic design just described should display a level of performance which is now being sought for oil-burners and other applications. One such measure which is of prime importance is the definition of the geometry of the spiral.

It is assumed here that the main dimensions of the fan wheel, the radius R and the length L (see FIGS. 1 and 2 respectively), are given and are expediently related so that the length is approximately the same as the radius, preferably between 80 and 120% of the latter. Such relative proportions in the wheel are an essential condition for obtaining the optimum fan construction.

Another similar condition relates to the position and shaping of the so-called tongue, i.e. the point in the spiral where the spiral wall 3 forms a rounded transition 20 to the outlet pipe 19 and where also the smallest cross-section of the duct 18 should be situated. In order to prevent high noise-levels the radial dimension in this cross-section, designated $(S\text{-}R)_{min}$ in FIG. 1, should be less than 2 to 3% of the wheel radius, while at the same time it should be borne in mind that an increase in the cross-section acts counter to a high fan pressure. For this reason the tongue 20 is preferably given a radius T which is twice as large as the said cross-section dimension.

After this, the spiral of the wall 3 is set out so that the radial cross-section of the duct 18 increases continuously in the direction of rotation 12. The cross-section area, which includes not only the area radially outside the ring of blades but also the upper duct area located inside the axial dimension H of the housing, should increase, in accordance with an important characteristic of the invention, by at least 3% for each 15° of the centre angle, viewed from the axial line 2. With such an increase the duct obtains, at its widest part 21, i.e. the region of the spiral at or after the upper section line III in FIG. 1 where the stream of air is directed tangentially and approaches the outlet pipe 19, a cross-section area which is at least equal to the wheel radius R times the wheel length L. With such a rapid and important increase in area a considerable part of the speed of the air is converted to pressure in the duct part 22 which leads to this section and which acts as a diffusor, and the fact that this increase in pressure is obtained early in the circulation through the spiral is of basic importance for keeping the static pressure downstream from the fan at a high level.

In the embodiment shown in the Drawing, the increase in the area of the duct occurs only in the radial direction, due to the fact that the dimension S of the spiral and thus the duct width S-R increases at the said rate whilst the housing dimension H is constant for the whole spiral. In an alternative version the duct geometry can be such that both the dimensions S-R and the dimension H are increased simultaneously and continuously from the angular range at or after the tongue 20 where the duct cross-section is smallest. A radial increase which is less than the indicated value of 3% per 15° can be compensated to a certain extent by making the housing dimension H correspondingly larger instead, so that the threshold value for the largest cross-section of the duct is still maintained. Tests have shown that the same high pressure values are not attained with a narrow spiral of this kind.

Irrespective of which of these alternatives for the development of the duct is used, it should be ensured that the wheel length L and the axial dimension H of the housing have an expedient mutual relationship. It has been confirmed by a series of comparative tests with different values for these parameters that the wheel length should be approximately $\frac{2}{3}$ or more of the housing dimension. If the ratio is reduced, the performance of the fan deteriorates, and the lower limit can therefore be set at 60%. The best results were obtained with a wheel which amounts to 70 to 75% of the housing dimension.

The shaping of the air intake 16 is also included as a very important step in the combination of measures according to the invention. As has been practiced before, the intake should be eccentric relative to the wheel so that the air flowing in from the outside is conducted to one side of the wheel while on its other side the wheel acts to increase the pressure. In the preferred embodiment shown in FIGS. 1–4 the intake comprises a tongue-shaped guide vane 23 which extends from the end wall 5 and is connected to it along a line 24 which extends in an arc on the inside, around and above the outer end 13 of the wheel. From here the guide vane extends obliquely inwards and downwards towards the end plate 10, above which it terminates with an inner end 25 at a distance A, and it therefore screens a considerable part of the wheel opening 15 and the inside 17 of the rings of blades from the intake. As can best be seen in the plan view in FIG. 1, only half or less of this inside periphery therefore remains open to the outside, while the remaining part of the wheel opening and the blade ring communicates with the diffusor part 22 of the spiral.

According to a characteristic shape of the guide vane, in the part located nearest to the tongue 20 it has an edge part 26 cut at an angle, comprising an inwardly directed edge 27 disposed so that it follows closely the inside 17 of the ring of blades, down to the inner end 25 of the guide vane, and a radially outwards extending edge 28 which extends near to and along the end plate 14 of the wheel. The edge part therefore closes off the suction side of the fan wheel from the rear space 29, and also cuts off the part of the duct cross-section which is located outside the outer end of the wheel, so that no air can penetrate over the latter into the suction side. For this reason it is preferable that the edge part 26 should extend right out to the spiral wall 3.

Figure 2:
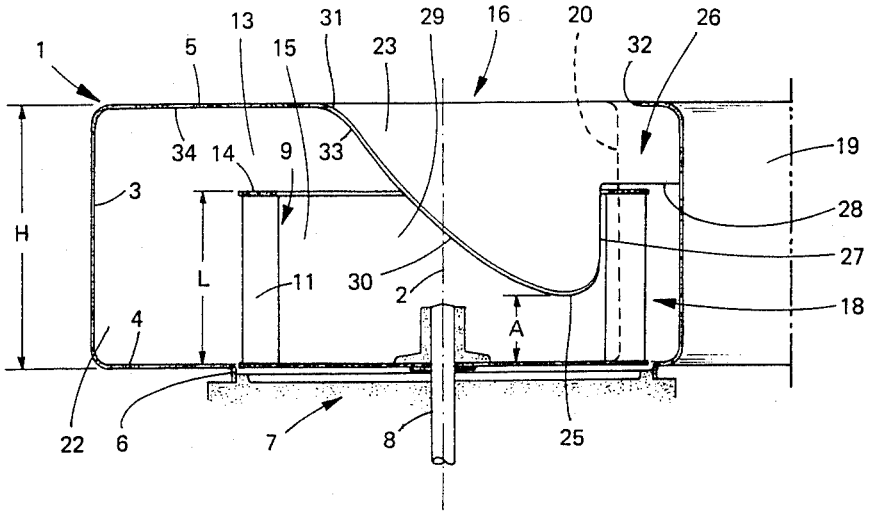
FIGS. 2 and 3 are axial sections through the radial fan along the lines II—II and III—III respectively in FIG. 1.
Figure 3:
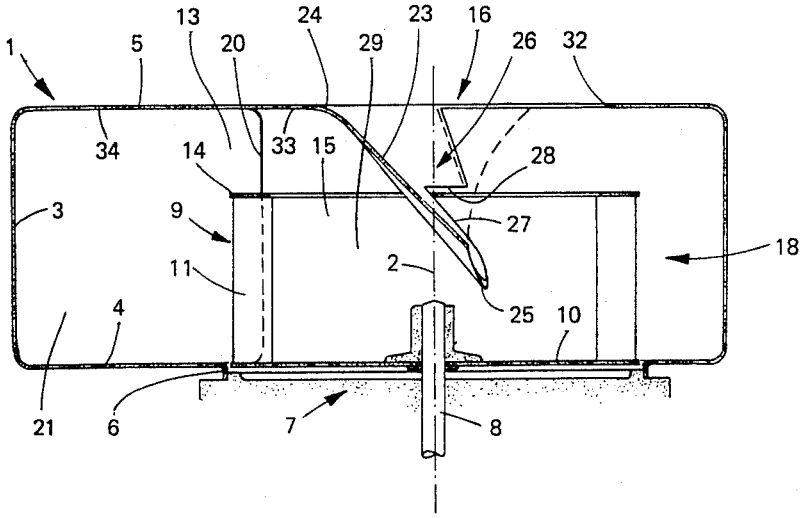

In the opposite direction the guide vane is defined by an edge 30 which extends obliquely outwards from the inner end 25 and is preferably curved like the latter. As can best be seen from the perspective view in FIG. 4, the edge 30 extends until it is on a level with the end wall 5 which it meets at the end point 31 of the line 24. This point is located radially inside the outer end 13 of the wheel, as shown in FIGS. 1–2.

Finally, the intake arrangement includes a boundary wall 32 which is constituted in the embodiment shown by a rim on the end wall 5 and extends above the end 13 of the wheel along the part of the periphery of the latter which is not covered by the guide vane 23, i.e. from the edge part 26 where the boundary wall continues as the line 24, to the point 31. According to a particular characteristic of the invention the inside radius of the boundary wall is reduced gradually in the direction of rotation so that it becomes less than the inner radius of the wheel. In the region nearest the point 31 the intake arrangement therefore reduces the effective part of the wheel opening 15.

Together with the inside of the end wall located just outwardly of the line 24, the rear face of the guide vane 23 forms a smooth flow surface 33 which extends over the part of the outer end of the wheel which is screened off. The fact that the flow surface continues smoothly into the wall surface 34 located radially beyond it within the diffusor part 22, is favourable for the flow and the recovery of pressure in the air rushing along here. Some of this air should be allowed to flow back from the diffusor, passing over the wheel 9 into the space 29 under the guide vane which controls and distributes this air by means of its rear face, so that some of it finds its way into the ring of blades and some passes by the inner end 25 of the guide vane to the suction side of the wheel.

Figure 4:
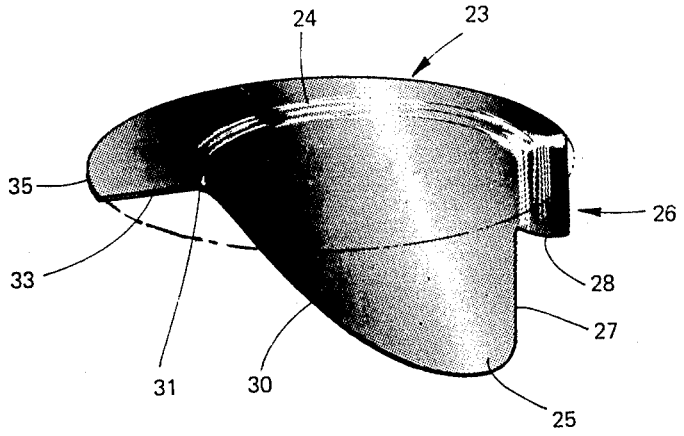
FIG. 4 is a perspective view of a guide vane which is incorporated in the radial fan shown in FIG. 1, while a modified version of the guide vane is shown in FIG. 5.
Figure 5:
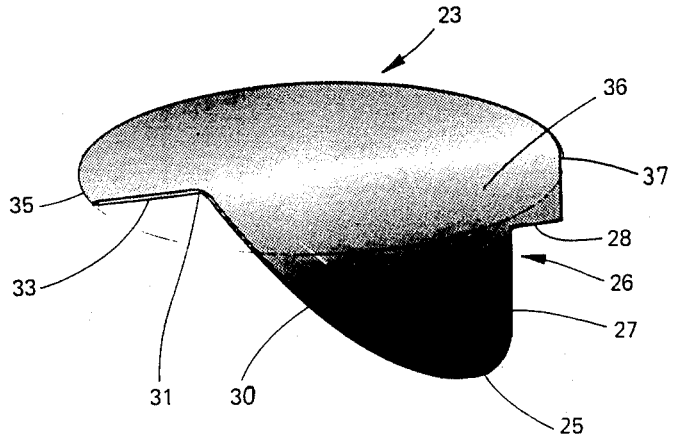

As shown in FIGS. 4–5, a guide vane of the kind described here can be made in a practical embodiment as a separate part which is fixed in the end wall 5 when the fan is being assembled. On its lower face the end wall can then have a concentric seat in which the outer edge 35 of the guide vane is guided and inserted so that the guide vane and the lower face of the end wall form the said flow surface 33, while at the same time the guide vane is given the correct rotational position. The dashed line in the Figures is an imaginery continuation of the said seat and outer edge and there is nothing to prevent the guide vane from having such a closed periphery and forming the boundary wall 32 of the air intake instead of the end wall 5.

In order to achieve a high level of performance it is important to have a design for the intake and the guide vane such that the different streams of air are controlled in the best way and are well balanced relative to each other. Relatively slight structural changes here can have a considerable effect and result in very appreciable differences in the properties of the fan. Thus, systematic tests carried out with the aim of finding the optimum have shown that, with the rest of the fan construction unchanged, changing the position and detailed shaping of the guide vane can have the following results:

Displacement of the guide vane towards the boundary wall 32, i.e. downwards in FIG. 1, so that the axial line is cut as shown in the Figures, or alternatively bending it to a shape such that the end 25 of the guide vane is moved in the same direction without increasing the dimension A, and/or extending the guide vane downwards so that the dimension A is reduced to approximately $\frac{1}{4}$, but not less than 1/10, of the wheel length L, has the effect of increasing the maximum static pressure at the same time as the intake area and therewith the flow of air is restricted, while a displacement in the opposite direction, facilitating the admission of air, and/or shortening the guide vane so that its end is located in the middle of the wheel or slightly above the axial line and has a dimension A of between $\frac{1}{4}$ and $\frac{1}{2}$ of the wall length, increases instead the quantity of air flowing through but restricts the pressure. If a higher value is sought for both the pressure and the quantity of air, it is necessary to "compromise" between these measures when working on the design.

A positive effect for both properties is obtained with the dished shape which the guide vane displays in the example shown in FIGS. 1–4. Compared with the version shown in FIG. 5, where the guide vane is a flat plate 36 which is bent round along a line extending from the point 31 to the side edge 37 adjoining the spiral wall 3, the dished shape results in a pressure increase of approximately 20%. Again, with regard to the quantity of air supplied, the version of FIG. 5 is inferior, but on the other hand it is more advantageous from the point of view of production and cost.

It is advantageous from the point of view of the capacity of air to combine the guide vane shown in FIGS. 1–4 with a ring or nozzle (not shown) which replaces the boundary wall 32 and, in a conventional way, has a profile curving inwards from the end wall 5 and pointing towards the outwardly exposed part of the wheel end 13, preferably following the plate 14 closely so that it facilitates the flow of air from outside through the intake to the inside 17 of the ring of blades. In the sector which is nearest the point 31 the inside of the nozzle can have the same shape, viewed from outside, as the boundary wall 32, while it is preferably shaped with a decreasing depth in the same sector.

Performance advantages can also be gained with the particular design of the fan housing. Thus, for example, if production methods do not give rise to problems, the tongue 20 can be moved slightly against the direction of rotation compared with the version shown in FIG. 1, so that the tongue is made as pointed as possible and its position is as close to the ring of blades as possible having regard to the noise aspect. At the same time, the position of the "wiper" edge part 26 of the guide vane can follow in approximately the same direction. These measures which result in, amongst other things, the spiral enclosing the wheel over a greater part of its periphery result in the pressure rising further by a few mm water column, but only at small quantities of air.

Figure 6:
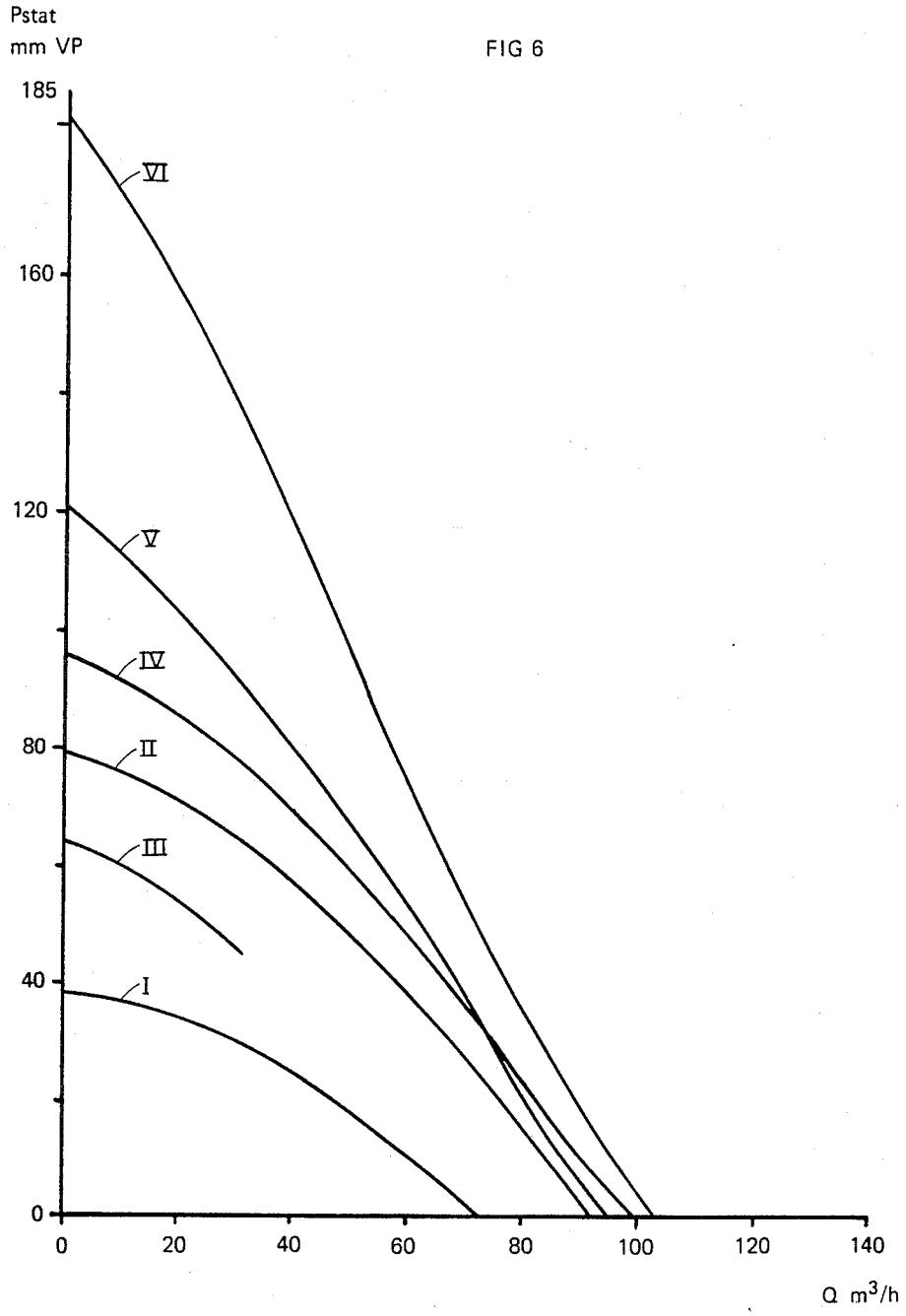
FIG. 6 is a diagram showing the fan pressure as a function of the quantity of air both for the radial fan according to the invention and for other products available on the market.

The results of the optimising process described above can be read off the diagram in FIG. 6, which shows how the static pressure P varies in different fans as a function of the quantity of air Q supplied. The pressure was measured at a tank with an inlet to which the outlet pipe of the fans was connected, and the equipment for determining the amount of air was also the same for each test.

The six characteristic curves which are shown in the Figure designated I–VI were obtained from the following:

I. A conventional American mass-produced fan. Concentric nozzle-shaped air intake.

II. A Swedish mass-produced fan manufactured according to Patent Application No. 7406642-4.

III. As II., but with test results converted.

IV. A laboratory embodiment. Fan housing geometry according to the present application. Air intake of foreign manufacture.

V. The fan as in I, but equipped with a wheel and an air intake according to the present application.

VI. A fan corresponding to the preferred embodiment in the present application.

The wheel diameter was the same size (108 mm) in Tests I, IV, V and VI. In Test II the wheel diameter was greater (120 mm), and the values from this Test were therefore converted to the lesser diameter by an accepted calculating method, so that the values given in III were obtained and the Test is comparable with the other Tests. As can be seen, there are very great differences between the various test results and the discrepancies are particularly marked with regard to pressure with Q=0, the so-called dammed point, and with small quantities of air. Compared with the conventionally-made American fan in Test I the fan according to the invention displayed an improvement at the dammed point by a factor of 4.6, and also with regard to the maximum quantity of air the invention gave substantially better values. It is also worthy of note that the fan which corresponds to curves II and III and is the design which was referred to at the beginning as the state of the art gives pressure values according to Test II which if regarded absolutely lie at a very low level, and that its maximum pressure could be increased by the present invention to almost three times the value, based on the converted value in III, and well over twice compared with the fan tested in II with the larger diameter. The last comparison shows that the invention not only results in a considerable improvement in performance obtained with designs which are already known, but that the improvement also makes it possible to reduce the wheel diameter while still achieving, with a good margin, the pressure and quantity values which are obtained with the other products. This was previously regarded as unattainable by men skilled in the art.

The result of Test IV is interesting when compared with Test VI since the former shows that the pressure values, good in themselves, which are obtained with a fan housing according to the invention equipped with an intake of foreign manufacture, are considerably improved if the intake is also made according to the invention, thus when all the combined measures according to the invention are employed.

The combined effect can also be seen clearly if the result of Test V is considered. Due to the fact that in this case the fan wheel and air intake according to the invention are arranged in a foreign housing, which gives an unacceptable level of performance (Test I) in conjunction with a foreign intake arrangement, an unexpectedly good result is obtained; however, this is greatly eclipsed by the result which is obtained (in Test VI) if the design of the fan housing is also changed.

As can be seen, the characteristic curve for the fan according to the invention lies as a whole clearly above the rest of the fans tested and it also has a steeper path, which means that the quantity of air supplied is not so sensitive to the counter-pressure prevailing in the appliance. The demands in this respect which are now being made on radial fans of this type are therefore also fulfilled.

I claim:

1. A radial flow fan having a fan wheel (9) which rotates in one direction on an axis (2) and which comprises a ring of circumferentially spaced blades (11), each extending between a disc-like axially inner end plate (10) and a concentric axially outer end ring (14) through which air flows to the inside of the ring of blades (11) to be propelled radially outward by them, and a housing (1) within which the fan wheel (9) rotates and which has an inner end wall (4) that is substantially coplanar with said inner end plate (10), an outer end wall (5) which is spaced axially outwardly from said end ring (14) and wherein there is an air inlet (16), and a spiral side wall (3) which extends around the fan wheel (9) in divergent relation to the fan wheel periphery from a tongue (20) location to an outlet (21) and which cooperates with said end walls (4, 5) and the ring of blades (11) to define a duct (18) around the fan wheel (9), said duct (18) merging at said outlet (21) into an outlet pipe (19) which is joined to the side wall (3) at said tongue (20) location and serving to conduct to said outlet pipe (19) air propelled through the ring of blades (11), said fan being characterized by:

A. said fan wheel (9) having an axial length (L) which is between 80% and 120% of its radius (R);

B. said duct (18)

(1) being of continuously increasing cross-section area in said direction of fan wheel (9) rotation from said tongue (20) location to said outlet (21) and (2) having at said outlet (21) a cross-section area at least equal to the radius (R) of the fan wheel times its axial length (L);

C. a vane (23) connected to said outer end wall (5) and projecting obliquely axially inwardly therefrom and away from said outlet (21) into the ring of blades (11) for guiding incoming air into the ring of blades at the portion thereof that is remote from said outlet (21), said vane (23)

(1) having a substantially straight side edge (27) that lies closely adjacent along its length to the ring of blades (11) at the inside thereof, and (2) having an inner end edge (25) which extends from the axially inner end of said side edge (27) substantially radially inwardly away from the ring of blades;

D. said air inlet (16) being defined by (1) said vane (23), and (2) an arcuate radially inwardly facing edge (32) of said outer end wall (5) which extends around not substantially more than half of the circumference of the ring of blades (11) and is substantially entirely at the side of said axis (2) that is remote from said outlet (21); and E. a baffle (26) projecting edgewise substantially radially from said vane (23) and extending across said ring of blades (11) towards said spiral side wall (3), said baffle having (1) an axially inner edge (28) adjacent to said end ring (14) and extending radially outwardly from the axially outer end of said side edge (27), and (2) an opposite outer edge adjacent and substantially parallel to said outer end wall (5).

2. The radial flow fan of claim 1, wherein the radial distance ($(S\text{-}R)_{min}$) between the periphery of the fan wheel (9) and said spiral side wall (3) at said tongue (20) location is on the order of 2% to 3% of the radius (R) of the fan wheel (9).

3. The radial flow fan of claim 2 wherein said spiral side wall (3) is joined to said outlet pipe (19) at a rounded tongue (20) at said tongue location, further characterized in that said tongue (20) is rounded on a radius (T) which is substantially equal to twice said radial distance ($(S\text{-}R)_{min}$).

4. The radial flow fan of claim 1 wherein said inner (4) and outer (5) end walls are normal to said axis (2), further characterized in that the cross section area of said duct (18) increases by at least 3% for each 15° around said axis (2) in said direction of rotation.

5. The radial flow fan of claim 1, further characterized in that said arcuate edge (32) of said outer end wall (5) has one end portion which is adjacent to said baffle (26) and which overlies said end ring (14), and from that end portion is of gradually decreasing radius relative to said axis (2) in said direction of rotation, to be nearer said axis (2) than the inner fan wheel periphery at its opposite end.

6. The radial flow fan of claim 1 wherein said inner edge (25) on said vane (23) is spaced at a distance (A) from said inner end plate (10) which is between 1/10 and ½ of the axial length (L) of the fan wheel (9).

7. The radial flow fan of claim 1, further characterized in that the axial length (L) of the fan wheel (9) is between 60% and 75% of the distance (H) between said end walls (4, 5) of the housing (1).

* * * * *